US010935900B2

(12) United States Patent
Ishizuka et al.

(10) Patent No.: US 10,935,900 B2
(45) Date of Patent: Mar. 2, 2021

(54) TONER FOR DEVELOPING ELECTROSTATIC CHARGE IMAGE, ELECTROSTATIC CHARGE IMAGE DEVELOPER, AND TONER CARTRIDGE

(71) Applicant: FUJI XEROX Co., Ltd., Tokyo (JP)

(72) Inventors: Daisuke Ishizuka, Kanagawa (JP); Narumasa Sato, Kanagawa (JP); Yuka Kawamoto, Kanagawa (JP); Erina Saito, Kanagawa (JP); Norimasa Ozora, Kanagawa (JP); Kotaro Yoshihara, Kanagawa (JP); Noriyuki Mizutani, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/533,162

(22) Filed: Aug. 6, 2019

(65) Prior Publication Data

US 2020/0292950 A1 Sep. 17, 2020

(30) Foreign Application Priority Data

Mar. 15, 2019 (JP) ..... JP2019-048829

(51) Int. Cl.
*G03G 9/097* (2006.01)
*G03G 9/08* (2006.01)
(Continued)

(52) U.S. Cl.
CPC ..... *G03G 9/0821* (2013.01); *G03G 9/0802* (2013.01); *G03G 9/08755* (2013.01);
(Continued)

(58) Field of Classification Search
CPC ..... G03G 9/09725; G03G 9/0821
See application file for complete search history.

(56) References Cited

U.S. PATENT DOCUMENTS 8,795,938 B2 * 8/2014 Uchinokura ..... G03G 9/08 430/108.3
9,417,542 B2 * 8/2016 Hiroko ..... G03G 9/0833
(Continued)

FOREIGN PATENT DOCUMENTS

JP 2011-043759 A 3/2011
JP 2015-125256 A 7/2015
JP 2017-015817 A 1/2017

OTHER PUBLICATIONS

Triton™ X-100 from Sigma-Aldrich. Retrieve Aug. 10, 2020 <<https://www.sigmaaldrich.com/catalog/product/sial/x100?lang=en&region=US>>.*

(Continued)

*Primary Examiner* — Christopher D Rodee
(74) *Attorney, Agent, or Firm* — Sughrue Mion, PLLC

(57) ABSTRACT

A toner for developing an electrostatic charge image includes toner particles containing a binder resin; and an external additive containing silica particles, in which a coefficient of variation of a Si content is determined by determining the Si content in 0.5 μm×0.5 μm square regions in a surface of each of the toner particles after performing a process of dispersing the toner in water and drying the dispersed toner, and an amount of change between this coefficient of variation of the Si content and a coefficient of variation of a Si content before the process ((coefficient of variation of Si content after process)−(coefficient of variation of Si content before process)) is 0.05 or more and 0.60 or less.

7 Claims, 3 Drawing Sheets

(51) Int. Cl.
*G03G 9/087* (2006.01)
*G03G 9/09* (2006.01)

(52) U.S. Cl.
CPC ..... *G03G 9/09* (2013.01); *G03G 9/097* (2013.01); *G03G 9/09725* (2013.01)

(56) References Cited

U.S. PATENT DOCUMENTS 10,274,853 B2* 4/2019 Itoh ..... G03G 9/0821
2003/0207191 A1* 11/2003 Kadota ..... G03G 9/0827 430/108.3
2004/0219448 A1* 11/2004 Kato ..... G03G 9/08782 430/108.6
2009/0196658 A1* 8/2009 Sugiura ..... G03G 9/09725 399/252
2010/0136473 A1* 6/2010 Ishigami ..... G03G 9/1131 430/111.35
2012/0251936 A1* 10/2012 Hamano ..... G03G 9/0906 430/105
2013/0244155 A1* 9/2013 Satoh ..... G03G 9/09725 430/105
2014/0220485 A1* 8/2014 Kojima ..... G03G 9/08755 430/105
2014/0302433 A1* 10/2014 Hasegawa ..... G03G 9/08755 430/108.3
2014/0315126 A1* 10/2014 Magome ..... G03G 9/0835 430/108.3
2014/0322639 A1* 10/2014 Suzumura ..... G03G 9/09725 430/108.3
2014/0335449 A1* 11/2014 Uratani ..... G03G 9/081 430/108.3
2014/0335450 A1* 11/2014 Nomura ..... G03G 9/0839 430/108.3
2014/0370427 A1* 12/2014 Sasaki ..... G03G 9/09725 430/105
2014/0370431 A1* 12/2014 Hiroko ..... G03G 9/0839 430/108.6
2015/0227067 A1* 8/2015 Hasegawa ..... G03G 9/0827 430/108.6
2015/0227068 A1* 8/2015 Sano ..... G03G 9/09725 430/108.3
2016/0161874 A1* 6/2016 Yamazaki ..... G03G 9/083 430/108.7
2018/0143557 A1* 5/2018 Ueda ..... G03G 9/0827
2019/0278191 A1* 9/2019 Suzuki ..... G03G 9/08797

OTHER PUBLICATIONS

"Japanese Industrial Standard Testing Methods for Transition Temperatures of Plastics", JIS K 7121, 1987, pp. 1-26.

* cited by examiner

TONER FOR DEVELOPING ELECTROSTATIC CHARGE IMAGE, ELECTROSTATIC CHARGE IMAGE DEVELOPER, AND TONER CARTRIDGE

CROSS-REFERENCE TO RELATED APPLICATIONS

This application is based on and claims priority under 35 USC 119 from Japanese Patent Application No. 2019-048829 filed Mar. 15, 2019.

BACKGROUND

(i) Technical Field

The present disclosure relates to a toner for developing an electrostatic charge image, an electrostatic charge image developer, and a toner cartridge.

(ii) Related Art

Methods for visualizing image information through electrostatic charge images, such as electrophotography, are now used in various fields.

An electrophotographic method generally employed heretofore involves multiple steps of forming an electrostatic latent image on a photoreceptor or an electrostatic recording member by using various units, allowing charge-detecting particles known as a toner to attach to the electrostatic latent image so as to develop the electrostatic latent image (toner image), transferring the toner image onto a recording medium surface, and fixing the toner image by heating.

For example, Japanese Unexamined Patent Application Publication No. 2015-125256 discloses a "nonmagnetic toner that includes inorganic fine particles and toner particles containing a binder resin and a crystalline polyester, in which the crystalline polyester has a melting point (Tm) of 60° C. or higher and 100° C. or lower and has a weight-average molecular weight (Mw) of 20000 or more and 50000 or less; 1.5 parts by mass or more and 3.0 parts by mass or less of the inorganic fine particles are contained relative to 100.0 parts by mass of the toner particles; silica fine particles account for 30.0 mass % or more of the inorganic fine particles and have a number-average primary particle diameter (D1) of 4.0 nm or more and 15.0 nm or less; the ratio of free inorganic fine particles is 10.0 mass % or more and 25.0 mass % or less; and the coefficient of variation in the fraction of the toner particles covered with the inorganic fine particles is 6.0% or less".

For example, Japanese Unexamined Patent Application Publication No. 2017-015817 discloses a "toner containing at least a binder resin and a releasing agent, and two or more types of inorganic fine particles as external additives, one of the external additives being silica, in which, when ultrasonic vibration is applied to a toner dispersion prepared by dispersing the toner in a dispersant, the applied ultrasonic wave energy at which 20% of silica detaches from the toner relative to the total amount of the silica is 8 kJ or more and 14 kJ or less and the applied ultrasonic wave energy at which 50% of silica detaches is 70 kJ or more and 130 kJ or less".

For example, Japanese Unexamined Patent Application Publication No. 2011-043759 discloses a "toner for developing an electrostatic charge image, in which an external additive is added to toner mother particles, the external additive has a number-average primary particle diameter of 20 nm or more and less than 80 nm, the ratio of the minimum particle diameter to the number-average primary particle diameter (minimum particle diameter/number-average primary particle diameter) is 0.5 or more, the ratio of the maximum particle diameter to the number-average primary particle diameter (maximum particle diameter/number-average primary particle diameter) is 1.7 or less, and the external additive is particles that are monodispersed on the surface of the toner mother particles".

SUMMARY

Aspects of non-limiting embodiments of the present disclosure relate to a toner that is used for developing an electrostatic charge image, that contains toner particles containing a binder resin and an external additive containing silica particles, and that suppresses contamination of a recording medium caused by clogging of a transfer residual toner recovery route irrespective of whether heat is applied to the toner compared to when the amount of change between a coefficient of variation of the Si content after a particular process and a coefficient of variation of the Si content before the particular process ((coefficient of variation of Si content after process)−(coefficient of variation of Si content before process)) is less than 0.05 or more than 0.60, when a hydroxy group-containing low-molecular-weight compound content is less than 500 ppm or more than 50,000 ppm, or when a ratio of components having a molecular weight of 50,000 or more in a molecular weight distribution obtained by measuring a tetrahydrofuran-soluble fraction of the toner particles by gel permeation chromatography is less than 15 mass % or more than 50 mass %.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a toner for developing an electrostatic charge image, the toner including toner particles containing a binder resin; and an external additive containing silica particles, in which a coefficient of variation of a Si content is determined by determining the Si content in 0.5 μm×0.5 μm square regions in a surface of each of the toner particles after performing a process of dispersing the toner in water and drying the dispersed toner, and an amount of change between this coefficient of variation of the Si content and a coefficient of variation of a Si content before the process ((coefficient of variation of Si content after process)−(coefficient of variation of Si content before process)) is 0.05 or more and 0.60 or less.

BRIEF DESCRIPTION OF THE DRAWINGS

Exemplary embodiments of the present disclosure will be described in detail based on the following figures, wherein.

DETAILED DESCRIPTION

Figure 1:
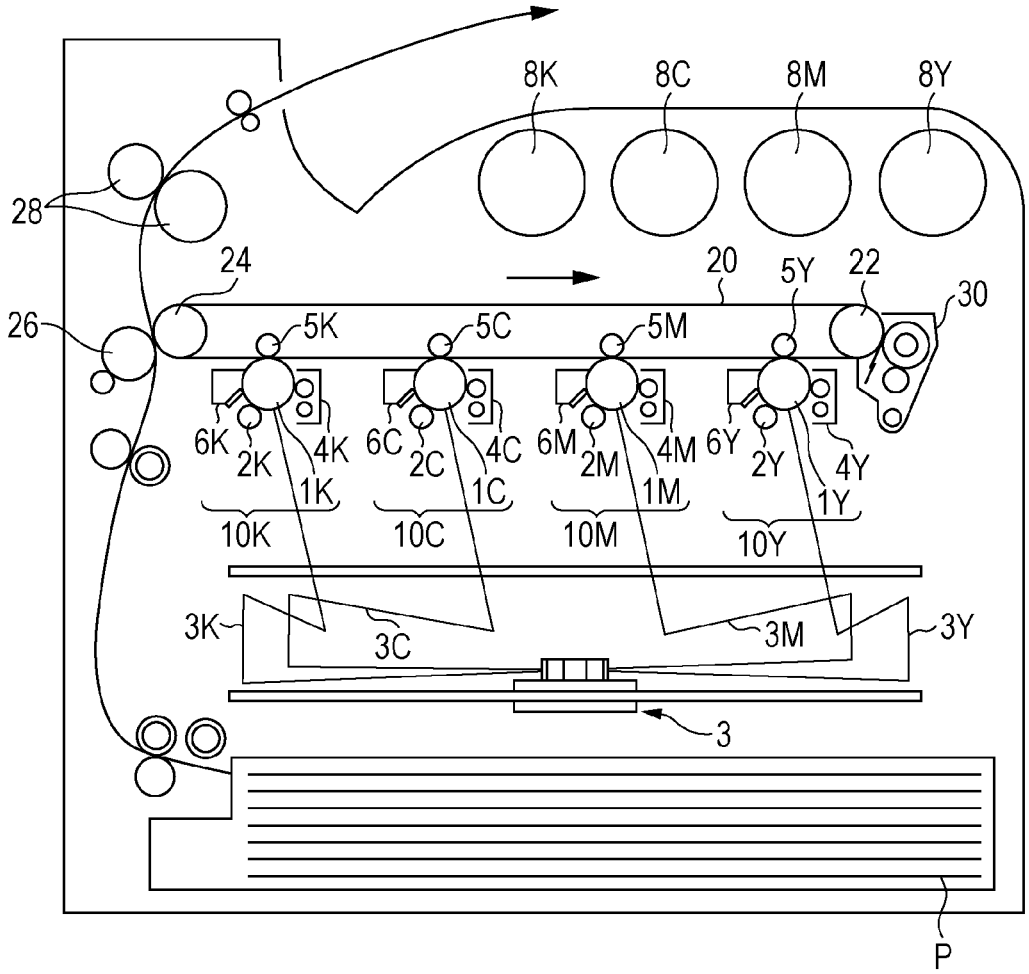
FIG. 1 is a schematic diagram of an image forming apparatus according to an exemplary embodiment.

An exemplary embodiment, which is one example of the present disclosure, will now be described.

In this description, when the amount of a component in a composition is referred and when there are two or more types of substances that correspond to that component in the composition, the amount is the total amount of the two or more types of the substances in the composition unless otherwise noted.

In this description, the "toner for developing an electrostatic charge image" may be simply referred to as the "toner", and the "electrostatic charge image developer" may be simply referred to as the "developer".

Toner for Developing Electrostatic Charge Image

The toner for developing an electrostatic charge image according to a first exemplary embodiment includes toner particles containing a binder resin and an external additive containing silica particles.

When the Si content in 0.5 μm×0.5 μm square regions in a surface of each of the toner particles is determined after performing a process of dispersing the toner in water and drying the dispersed toner, the amount of change between the coefficient of variation of the Si content after the process and the coefficient of variation of the Si content before the process ((coefficient of variation of Si content after process)−(coefficient of variation of Si content before process), hereinafter this range may be referred to as the "amount of change in coefficient of variation of the Si content between before and after a particular process") is 0.05 or more and 0.60 or less.

Due to the above-described features, the toner of the first exemplary embodiment suppresses contamination of a recording medium caused by clogging of the transfer residual toner recovery route irrespective of whether heat is applied to the toner. The reason behind this is presumably as follows.

Typically, when heat is applied to the toner in the toner cartridge, the external additive becomes entirely buried in the toner particle surfaces. Such a toner exhibits degraded transferability, and thus the amount of the transfer residual toner increases. The "transfer residual toner" refers to the toner remaining on the image carrier after the transfer of the toner image.

The transfer residual toner is scraped off with a cleaning blade, passes through the toner recovery route, and is sent to a recovery container or the like. Clogging may occur in the transfer residual toner recovery route. Once the recover route is clogged, the transfer residual toner cannot be recovered, and the recording medium may become contaminated due to the toner blown out inside the apparatus, for example.

In particular, when there is a difference in image density in an in-out direction (in other words, between the right side and the left side with respect to the direction in which the sheet is fed), the transfer residual toner remains inside the recover route, readily forms toner agglomerates, and sometimes causes clogging.

This is presumably due to the heat applied to the toner, which causes the external additive to be buried in the toner particles, thereby strengthens adhesion between the toner particles, and creates a state in which the toner particles are densely packed.

Meanwhile, controlling the glass transition temperature Tg of the toner, the molecular weight of the binder resin in the toner, etc., suppresses burying of the external additive caused by heat.

However, in such a case, the mechanical load applied inside the developing unit induces the external additive to detach from the toner particles. Thus, due to the detachment of the external additive, the amount of the external additive on the transfer residual toner also decreases. Thus, the amount of the transfer residual toner increases, adhesion between the toner particles is strengthened, the transfer residual toner recovery route becomes clogged, and the recording medium may become contaminated.

In contrast, according to the toner of the first exemplary embodiment, a surface of one toner particle has a structure in which regions where the silica particles serving as an external additive are attached with high adhesion force and regions where the silica particles serving as an external additive are attached with low adhesion force are distributed.

Specifically, the amount of change in coefficient of variation of the Si content between before and after a particular process is set to 0.05 or more and 0.60 or less.

Here, the "Si content in each of the 0.5 μm×0.5 μm square regions in the surface of the toner particle" refers to the abundance of the silica particles serving as an external additive in each region. A large coefficient of variation of the Si content indicates that the silica particles are nearly evenly attached to the toner particle, and a small coefficient of variation of the Si content indicates that the silica particles are nearly unevenly attached to the toner particle.

In other words, the fact that the amount of change in coefficient of variation of the Si content between before and after the process is within the aforementioned range indicates that silica particles are more unevenly attached to the toner particle after the process than before the process.

Thus, when the amount of change in coefficient of variation of the Si content between before and after the process is within the aforementioned range, one toner particle has a structure in which regions where the silica particles serving as an external additive are attached with high adhesion force and regions where the silica particles serving as an external additive are attached with low adhesion force are distributed.

When heat is applied to the toner having the aforementioned structure, the silica particles attached to the toner particle with high adhesion force become buried in the toner particle while the silica particles attached to the toner particle with low adhesion force are not easily buried. Thus, the silica particles attached to the toner particle with low adhesion force exhibit a spacer function between the toner particles, and suppress an increase in the amount of transfer residual toner and an increase in the adhesion force between the toner particles. As a result, even when heat is applied to the toner, contamination of a recording medium caused by clogging of the transfer residual toner recovery route is suppressed.

Moreover, even when a mechanical load is applied to the toner having the aforementioned structure, although the silica particles attached to the toner particle with low adhesion force tend to detach first, the silica particles attached to the toner particle with high adhesion force tend to stay undetached from the toner particle. Thus, the silica particles attached to the toner particle with high adhesion force suppress the increase in the amount of transfer residual toner and the increase in the adhesion force between the toner particles. As a result, even when heat is not applied to the toner, contamination of a recording medium caused by clogging of the transfer residual toner recovery route is suppressed.

Presumably due to the above-described features, the toner of the first exemplary embodiment suppresses contamination of a recording medium caused by clogging of the transfer residual toner recovery route irrespective of whether heat is applied to the toner.

Meanwhile, a toner for developing an electrostatic charge image according to a second exemplary embodiment includes toner particles containing a binder resin and a low-molecular-weight compound having a hydroxy group, and an external additive containing silica particles.

The low-molecular-weight compound content relative to the toner particles is 500 ppm or more and 50,000 ppm or less, and the ratio of the components having a molecular weight of 50,000 or more in a molecular weight distribution obtained by measuring the tetrahydrofuran-soluble fraction of the toner particles by gel permeation chromatography is 15 mass % or more and 50 mass % or less.

Due to the above-described features, the toner of the second exemplary embodiment suppresses contamination of a recording medium caused by clogging of the transfer residual toner recovery route irrespective of whether heat is applied to the toner. The reason behind this is presumably as follows.

The low-molecular-weight compound having a hydroxy group strongly adheres to silica particles serving as an external additive. Thus, when the low-molecular-weight compound exists on the surfaces toner particles, the adhesion force to the silica particles is increased.

When the toner particles contain 15% or more and 50% or less of the components having a molecular weight of 50,000 or more in a molecular weight distribution obtained by measuring the tetrahydrofuran-soluble fraction of the toner particles by gel permeation chromatography, the low-molecular-weight compound does not easily spread over the entire toner particles. Thus, regions where the low-molecular-weight compound is abundant and regions where the low-molecular-weight compound is scarce are formed on a surface of one toner particle.

In other words, on a surface of one toner particle, regions where the low-molecular-weight compound is abundant constitute the "regions where the silica particles serving as an external additive are attached with high adhesion force", regions where the low-molecular-weight compound is scarce constitute the "regions where the silica particles serving as an external additive are attached with low adhesion force", and thus a structure in which these regions are distributed is formed.

Presumably thus, as with the toner of the first exemplary embodiment, the toner of the second exemplary embodiment suppresses contamination of a recording medium caused by clogging of the transfer residual toner recovery route irrespective of whether heat is applied to the toner.

A toner that corresponds to both toners of the first and second exemplary embodiments (hereinafter this toner may be referred to as the "toner of the exemplary embodiment") will now be described in detail. However, it suffices if one example of the toner of the present disclosure is a toner that corresponds to one of the toners of the first and second exemplary embodiments.

In the description below, the toner for developing an electrostatic charge image of this exemplary embodiment is described in detail.

Coefficient of Variation of Si Content

In the toner of the exemplary embodiment, the amount of change in coefficient of variation of the Si content between before and after a particular process is 0.05 or more and 0.60 or less, and, from the viewpoint of suppressing contamination of a recording medium, is preferably 0.10 or more and 0.55 or less and is more preferably 0.15 or more and 0.50 or less.

From the viewpoint of suppressing contamination of a recording medium, the coefficient of variation of the Si content after a particular process is preferably 0.20 or more and 0.80 or less, more preferably 0.25 or more and 0.75 or less, and yet more preferably 0.30 or more and 0.70 or less.

Here, specifically, a process of dispersing the toner in water and drying the dispersed toner includes the following steps.

1) Step of preparing an aqueous solution by adding 2 g of the toner to 100 mL of a Triton X-100 (produced by FUJIFILM Wako Pure Chemical Corporation; IUPAC name: 2-[4-(2,4,4-trimethylpentan-2-yl)phenoxy]ethanol) 0.2 mass % aqueous solution.

2) Step of stirring the prepared solution for 10 minutes by using a magnetic stirrer "HS-360 (AS ONE Corporation)" at a rotating speed of 250 rpm and then processing the resulting solution in a centrifugal separator to remove silica particles that have detached from the toner particles.

3) Step of removing the silica particles that have detached from the toner particles and then drying the toner at a temperature of 40° C. for 24 hours.

The method for determining a Si content in 0.5 μm×0.5 μm square regions in a surface of a toner particle and the method for calculating the coefficient of variation of the Si content use a scanning electron microscope (SEM) equipped with an energy dispersive X-ray spectroscope (EDX device). The methods are specifically as follows.

Figure 3:
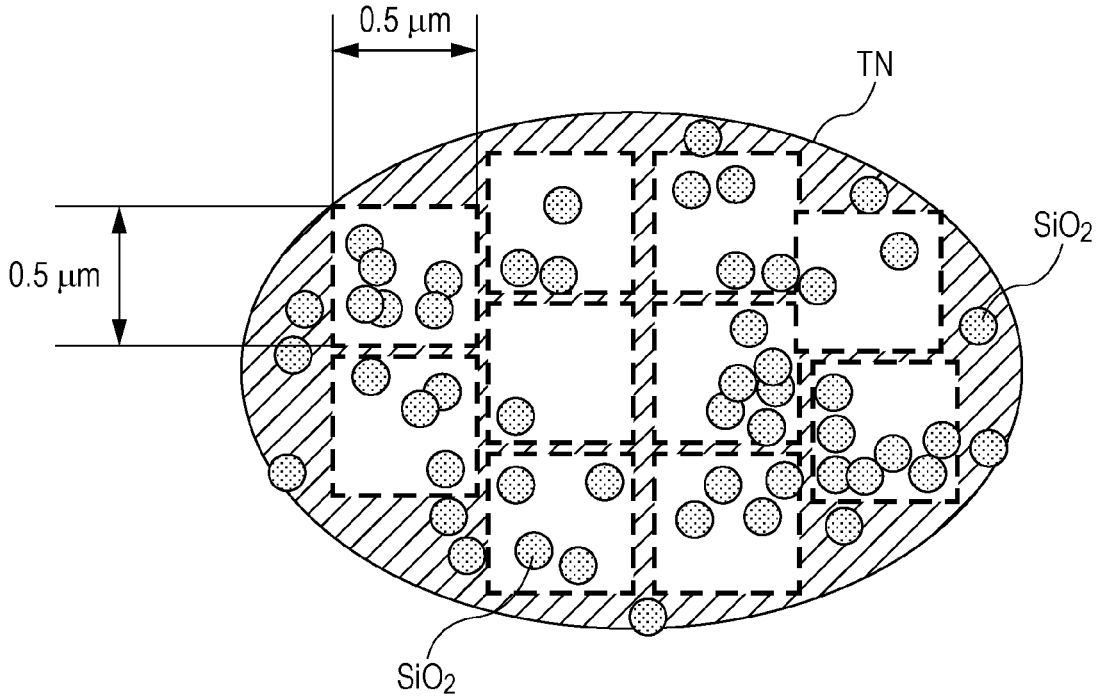
FIG. 3 is a diagram illustrating a method for determining a Si content in 0.5 μm×0.5 μm regions in a surface of a toner particle, and a method for calculating the coefficient of variation of the Si content.

First, one toner particle is observed with a SEM at a magnification of 20,000×. The surface of the one toner particle observed is divided into 0.5 μm×0.5 μm square regions (see FIG. 3, note that, in FIG. 3, TN represents a toner particle and $SiO_2$ represents silica particles). The surface is divided so that a maximum number of 0.5 μm×0.5 μm square regions are contained in the surface of one toner particle.

Next, the EDX device is used to conduct elemental analysis for each of the divided regions at an acceleration voltage of 5 kV so as to measure the Si element content (mass %).

On the basis of the Si contents of the respective regions, the coefficient of variation of the Si content is calculated by the formula: coefficient of variation of Si content=(standard deviation)/(average value).

This operation is performed on ten toner particles, and the average value of the obtained coefficients of variation of the Si contents is calculated.

Structure of the Toner

The toner of the exemplary embodiment includes toner particles and an external additive.

The toner particles contain a binder resin and a low-molecular-weight compound having a hydroxy group. The toner particles may further contain a coloring agent, a releasing agent, and other additives if needed.

Examples of the toner particles include, but are not limited to, yellow toner particles, magenta toner particles, cyan toner particles, black toner particles, white toner particles, transparent toner particles, and photoluminescent toner particles.

Binder Resin

Examples of the binder resin include vinyl resins composed of homopolymers of monomers and copolymers obtained by combining two or more monomers. Examples of the monomers include styrenes (for example, styrene, parachlorostyrene, and α-methylstyrene), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate), ethylenically unsaturated nitriles (for example, acrylonitrile and methacrylonitrile), vinyl ethers (for example, vinyl methyl ether and vinyl isobutyl ether), vinyl ketones (vinyl methyl ketone, vinyl ethyl ketone, and vinyl isopropenyl ketone), and olefins (for example, ethylene, propylene, and butadiene).

Examples of the binder resin also include non-vinyl resins such as epoxy resins, polyester resins, polyurethane resins, polyamide resins, cellulose resins, polyether resins, and modified rosin, mixtures of the vinyl resins and the non-vinyl resins described above, and graft polymers obtained by polymerizing vinyl monomers in the co-presence of these.

These binder resins may be used alone or in combination.

The binder resin may be a polyester resin.

Examples of the polyester resin include known polyester resins.

An example of the polyester resin is a condensation polymer of a polycarboxylic acid and a polyhydric alcohol. A commercially available polyester resin may be used, or a polyester resin prepared by synthesis may be used.

Examples of the polycarboxylic acid include aliphatic dicarboxylic acids (for example, oxalic acid, malonic acid, maleic acid, fumaric acid, citraconic acid, itaconic acid, glutaconic acid, succinic acid, alkenylsuccinic acid, adipic acid, and sebacic acid), alicyclic dicarboxylic acids (for example, cyclohexanedicarboxylic acid), aromatic dicarboxylic acids (for example, terephthalic acid, isophthalic acid, phthalic acid, and naphthalene dicarboxylic acid), anhydrides thereof, and lower (for example, having 1 to 5 carbon atoms) alkyl esters thereof. Among these, aromatic dicarboxylic acids may be used as the polycarboxylic acid.

For the polycarboxylic acids, a trivalent or higher carboxylic acid that has a crosslinked structure or a branched structure may be used in combination with a dicarboxylic acid. Examples of the trivalent or higher carboxylic acids include trimellitic acid, pyromellitic acid, anhydrides thereof, and lower (for example, having 1 to 5 carbon atoms) alkyl esters thereof.

The polycarboxylic acids may be used alone or in combination.

Examples of the polyhydric alcohol include aliphatic diols (for example, ethylene glycol, diethylene glycol, triethylene glycol, propylene glycol, butanediol, hexanediol, and neopentyl glycol), alicyclic diols (for example, cyclohexanediol, cyclohexanedimethanol, and hydrogenated bisphenol A), and aromatic diols (for example, an ethylene oxide adduct of bisphenol A and a propylene oxide adduct of bisphenol A). Of these, the polyhydric alcohol is, for example, preferably an aromatic diol or an alicyclic diol, and more preferably is an aromatic diol.

For the polyhydric alcohol, a trihydric or higher alcohol that has a crosslinked structure or a branched structure may be used in combination with a diol. Examples of the trihydric or higher alcohols include glycerin, trimethylolpropane, and pentaerythritol.

The polyhydric alcohols may be used alone or in combination.

The glass transition temperature (Tg) of the polyester resin is preferably 45° C. or higher and 80° C. or lower and is more preferably 50° C. or higher and 70° C. or lower.

The glass transition temperature is determined from a DSC curve obtained by differential scanning calorimetry (DSC). More specifically, the glass transition temperature is determined from the "extrapolated glass transition onset temperature" described in the method for determining the glass transition temperature in JIS K7121-1987 "Testing Methods for Transition Temperatures of Plastics".

The weight-average molecular weight (Mw) of the polyester resin is preferably 5,000 or more and 1,000,000 or less and more preferably 7,000 or more and 500,000 or less.

The number-average molecular weight (Mn) of the polyester resin may be 2,000 or more and 100,000 or less.

The molecular weight distribution Mw/Mn of the polyester resin is preferably 1.5 or more and 100 or less and more preferably 2 or more and 60 or less.

The weight-average molecular weight and the number-average molecular weight are measured by gel permeation chromatography (GPC). The molecular weight measurement by GPC is conducted by using GPC•HLC-8120GPC produced by TOSOH CORPORATION as a measuring instrument with columns, TSKgel Super HM-M (15 cm) produced by TOSOH CORPORATION, and a THF solvent. The weight-average molecular weight and the number-average molecular weight are calculated from the measurement results by using the molecular weight calibration curves obtained from monodisperse polystyrene standard samples.

The polyester resin is obtained by a known production method. Specifically, for example, the polyester resin is obtained by setting the polymerization temperature to 180° C. or higher and 230° C. or lower, decreasing the pressure in the reaction system as necessary, and performing a reaction while removing water and alcohol generated during condensation.

When the monomers used as the raw materials do not dissolve or are not compatible with each other at a reaction temperature, a solvent having a high boiling point may be added as a dissolving aid to dissolve the monomers. In this case, the polycondensation reaction is performed while distilling away the dissolving aid. When monomers poorly compatible with each other are present, the poorly compatible monomer and an acid or alcohol to be subjected to polycondensation with that monomer may be preliminarily condensed, and then the resulting product may be subjected to polycondensation with another component.

The amount of the binder resin relative to the entire toner particles is, for example, preferably 40 mass % or more and 98 mass % or less, is more preferably 50 mass % or more and 96 mass % or less, and is yet more preferably 60 mass % or more and 94 mass % or less.

Low-Molecular-Weight Compound

The low-molecular-weight compound has a hydroxy group. Here, the low-molecular-weight compound refers to an organic compound having a molecular weight of 50 or more and 600 or less (preferably 60 or more and 500 or less and more preferably 80 or more and 400 or less).

Examples of the low-molecular-weight compound include phenolic compounds, hydroxycarboxylic acid or ester compounds thereof, alcohol compounds, and ester compounds of polyhydric alcohols. The low-molecular-weight compounds may be used alone or in combination.

Among these, at least one selected from the phenolic compounds, hydroxycarboxylic acid and ester compounds thereof, and alcohol compounds may be used as the low-molecular-weight compound from the viewpoint of suppressing contamination of the recording medium.

A phenolic compound is a compound having a phenolic hydroxyl group. Examples of the phenolic compound include a substituted phenol containing one hydroxyl group (phenol, cresol, xylenol, para-alkylphenol, para-phenylphenol, or the like), a substituted phenol containing two hydroxyl groups (catechol, resorcinol, hydroquinone, or the like), a bisphenol (bisphenol A, bisphenol Z, or the like), and a substituted phenol containing three or more hydroxyl groups (pyrogallol, phloroglucinol, hexahydroxybenzene, or the like).

Examples of the hydroxycarboxylic acid and ester compounds thereof include lactic acid, malic acid, citric acid, 12-hydroxystearic acid, ricinoleic acid, salicylic acid, and ester compounds thereof.

An alcohol compound is a compound having an alcoholic hydroxyl group. Examples of the alcohol compound is as follows.

Examples of a monohydric alcohol include aliphatic alcohols (capryl alcohol, lauryl alcohol, myristyl alcohol, cetyl alcohol, stearyl alcohol, oleyl alcohol, and linoleyl alcohol) and aromatic alcohols (benzyl alcohol, phenethyl alcohol, salicyl alcohol, and diphenylmethanol).

Examples of a dihydric alcohol include aliphatic diols (for example, ethylene glycol, diethylene glycol, triethylene glycol, propylene glycol, butanediol, hexanediol, and neopentyl glycol), and alicyclic diols (for example, cyclohexanediol, cyclohexane dimethanol, and hydrogenated bisphenol A).

Aromatic diols (for example alkylene oxide adducts of bisphenol A (bisphenol A-ethylene oxide adduct, bisphenol A-propylene oxide adduct, and bisphenol A-ethylene propylene oxide adduct)).

Trihydric or higher alcohols (for example, glycerin, trimethylolpropane, and pentaerythritol).

Examples of the ester compounds of polyhydric alcohols include ester compounds having hydroxyl groups, such as fatty acid monoglyceride and fatty acid diglyceride.

In particular, from the viewpoint of suppressing contamination of a recording medium, the low-molecular-weight compound is preferably an alcohol compound, more preferably a monohydric or dihydric aromatic alcohol, and yet more preferably a bisphenol A-alkylene oxide adduct.

When a polyester resin is used as the binder resin, from the viewpoint of suppressing contamination of a recording medium, the absolute value $|Cp-CL|$ of the difference between the average number Cp of carbon atoms in the polyhydric alcohol constituting the polyester resin and the number CL of carbon atoms in the low-molecular-weight compound is preferably $|Cp-CL|\leq 8$, is more preferably $|Cp-CL|\leq 7$, and is yet more preferably $|Cp-CL|\leq 6$.

When the relationship between the polyester resin and the low-molecular-weight compound is the above-described relationship, the low-molecular-weight compound easily and appropriately spreads over the entire toner particles. Thus, there is a higher tendency of creating, in the surface of one toner particle, a structure in which regions where the low-molecular-weight compound is abundant (in other words, the regions where the silica particles serving as an external additive are attached with high adhesion force) and regions where the low-molecular-weight compound is scarce (in other words, the regions where the silica particles serving as an external additive are attached with low adhesion force) are nearly evenly distributed.

As a result, contamination of a recording medium caused by clogging of the transfer residual toner recovery route is easily suppressed irrespective of whether heat is applied to the toner.

The low-molecular-weight compound content is 500 ppm or more and 50,000 ppm or less. From the viewpoint of suppressing contamination of the recording medium, the low-molecular-weight compound content is preferably 1,000 ppm or more and 40,000 ppm or less, more preferably 2,000 ppm or more and 30,000 ppm or less, and yet more preferably 2,500 ppm or more and 25,000 ppm or less. The ppm is on a mass basis.

The low-molecular-weight compound content is measured as follows.

1) One gram of the toner is dispersed in 10 ml of methanol, ultrasonic wave is applied, and the supernatant is extracted.

2) The low-molecular-weight compound having a hydroxy group is identified by H-NMR by using the obtained supernatant.

3) A methanol solution containing a specified low-molecular-weight compound and having a known concentration is measured by high performance liquid chromatography (HPLC), and calibration curves are prepared from the obtained spectrum.

4) A supernatant obtained by high performance liquid chromatography (HPLC) is measured, and the content of the specified low-molecular-weight compound is calculated from the obtained spectrum and the calibration curves.

The instruments and conditions used in high performance liquid chromatography (HPLC) are as follows.

Analyzer: LaChromElite L-2000, Hitachi High-Technologies Corporation

Column: Gelpack GL-W520-S (diameter 7.8 mm×300 mm) Hitachi Chemical Co., Ltd.

Detector: L-2455 model diode array detector, Hitachi High-Technologies Corporation Measurement wavelength: UV 190 nm to 400 nm Quantitative analysis wavelength: UV 284 nm Mobile phase: 50 mM dipotassium hydrogenphosphate Liquid feed rate: 1.0 mL/min Sample injection amount: 10 μL Coloring Agent Examples of the coloring agent include pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, dupont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, and malachite green oxalate; and dyes such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

These coloring agents may be used alone or in combination.

The coloring agent may be a surface-treated coloring agent or may be used in combination with a dispersant, if needed. Two or more coloring agents may be used in combination.

The amount of the coloring agent relative to the entire toner particles is preferably 1 mass % or more and 30 mass % or less and is more preferably 3 mass % or more and 15 mass % or less.

Releasing Agent

Examples of the releasing agent include hydrocarbon wax; natural wax such as carnauba wax, rice wax, and candelilla wax; synthetic or mineral or petroleum wax such as montan wax; and ester wax such as fatty acid esters and montanic acid esters. The releasing agent is not limited to these.

The melting temperature of the releasing agent is preferably 50° C. or higher and 110° C. or lower and is more preferably 60° C. or higher and 100° C. or lower.

The melting temperature is determined from the DSC curve obtained by differential scanning calorimetry (DSC) by the method described in "Melting peak temperature", which is one method for determining the melting temperature in JIS K7121-1987 "Testing Methods for Transition Temperatures of Plastics".

The releasing agent content relative to, for example, the entire toner particles is preferably 1 mass % or more and 20 mass % or less and is more preferably 5 mass % or more and 15 mass % or less.

Other Additives

Examples of other additives include known additives such as magnetic materials, charge controllers, and inorganic powder. These additives are internal additives and contained inside the toner particles.

Properties, Etc., of Toner Particles

The toner particles may be a single-layer-structure toner particles, or core-shell-structure toner particles each constituted by a core (core particle) and a coating layer (shell) coating the core.

Core-shell toner particles may include a core containing a binder resin and, optionally, a coloring agent and other additives such as a releasing agent, and a coating layer that contains a binder resin, for example.

The low-molecular-weight compound may be present at least on the surfaces of the toner particles and may be contained in the core and the coating portion.

The ratio of the components having a molecular weight of 50,000 or more in a molecular weight distribution obtained by measuring the tetrahydrofuran-soluble fraction (hereinafter may also be referred to as the "THF-soluble fraction") of the toner particles by gel permeation chromatography (hereinafter may also be referred to as the "GPC measurement") is 15 mass % or more and 50 mass % or less (preferably 20 mass % or more and 45 mass % or less and more preferably 22 mass % or more and 42 mass % or less).

When the ratio of the components having a molecular weight of 50,000 or more in a molecular weight distribution obtained by GPC measurement of the THF-soluble fraction in the toner particles is within the aforementioned range, the low-molecular-weight compound does not easily spread over the entire toner particles. As a result, contamination of a recording medium caused by clogging of the transfer residual toner recovery route is suppressed irrespective of whether heat is applied to the toner.

The molecular weight distribution in the GPC measurement of the THF-soluble fraction in the toner particles and the ratio of the components having a molecular weight of 50,000 or more are measured as follows.

First, 0.5 mg of toner particles (or toner) to be measured are dissolved in 1 g of tetrahydrofuran (THF). The resulting mixture is ultrasonically dispersed and adjusted to have a concentration of 0.5%. The dissolved components are then measured by GPC.

As a GPC system, "HLC-8120GPC, SC-8020 (produced by TOSOH CORPORATION)" is used. Two columns, "TSKgel, SuperHM-H (produced by TOSOH CORPORATION, 6.0 mm ID×15 cm)" are used. THF is used as an eluent. Experimental conditions are sample concentration: 0.5%, flow rate: 0.6 ml/min, sample injection amount: 10 μl, measurement temperature: 40° C., and experiments are conducted by using a refractive index (RI) detector. The calibration curves are prepared from ten samples of "polystyrene standard samples, TSK standard": "A-500", "F-1", "F-10", "F-80", "F-380", "A-2500", "F-4", "F-40", "F-128", and "F-700". The data collecting intervals in the sample analysis are set to 300 ms.

From the obtained molecular weight distribution (in other words, the GPC chart), the areas with a molecular weight of 50,000 or more are integrated to calculate the ratio of the components having a molecular weight of 50,000.

From the viewpoint of suppressing contamination of a recording medium, the ratio B1/B2 of the measured value B1 of a specific surface area of the toner particles to the calculated specific surface area B2 of the toner particles determined from the volume-average particle diameter is preferably 1.2 or more and 5.0 or less, more preferably 1.4 or more and 4.5 or less, and yet more preferably 1.5 or more and 4.0 or less.

It is considered that appropriate irregularities are formed on the toner particle surfaces by setting the ratio of the measured value B1 to the specific surface area B2 to be within the aforementioned range. Thus, contamination of a recording medium caused by clogging of the transfer residual toner recovery route is easily suppressed irrespective of whether heat is applied to the toner.

The measured value B1 of the specific surface area of the toner particles is preferably 0.5 $m^2/g$ or more and 10.0 $m^2/g$ or less and more preferably 0.6 $m^2/g$ or more and 8.0 $m^2/g$ or less from the viewpoint of suppressing contamination of a recording medium.

Meanwhile, the calculated specific surface area B2 of the toner particles determined from the volume-average particle diameter is preferably 0.4 $m^2/g$ or more and 5 $m^2/g$ or less and more preferably 0.5 $m^2/g$ or more and 4.0 $m^2/g$ or less.

The measured value B1 of the specific surface area of the toner particles is the value measured by a nitrogen adsorption method. Specifically, measurement is performed through a BET method and a one-point measurement method of the nitrogen adsorption method. The equilibrium relative pressure is set to 0.3.

Meanwhile, the calculated specific surface area B2 of the toner particles determined from the volume-average particle diameter is measured as follows.

$$B2=(\text{surface area of toner particle})/\{(\text{specific gravity of toner particle})\times(\text{volume of toner particle})\}$$

Here, when the volume-average particle diameter of the toner is D50v, $$(\text{Surface area of toner})=4\times\pi\times(D50v/2)^2$$

$$(\text{Volume of toner})=4/3\times\pi\times(D50v/2)^3$$

The volume-average particle diameter (D50v) of the toner particles is preferably 2 μm or more and 10 μm or less and more preferably 4 μm or more and 8 μm or less.

Various average particle diameters and particle size distribution indices of the toner particles are measured by using a Coulter Multisizer II (produced by Beckman Coulter Inc.) with ISOTON-II (produced by Beckman Coulter Inc.) as the electrolyte.

In measurement, 0.5 mg or more and 50 mg of a measurement sample is added to 2 ml of a 5% aqueous solution of a surfactant (may be sodium alkyl benzenesulfonate) serving as the dispersant. The resulting mixture is added to 100 ml or more and 150 ml or less of the electrolyte.

The electrolyte in which the sample is suspended is dispersed for 1 minute in an ultrasonic disperser, and the particle size distribution of the particles having a diameter in the range of 2 μm or more and 60 μm or less is measured by using Coulter Multisizer II with apertures having an aperture diameter of 100 μm. The number of the particles sampled is 50,000.

With respect to the particle size ranges (channels) divided on the basis of the measured particle size distribution, cumulative distributions of the volume and the number are plotted from the small diameter side. The particle diameters at 16% cumulation are defined as a volume particle diameter D16v and a number particle diameter D16p, the particle diameter at 50% cumulation are defined to be a volume-average particle diameter D50v and cumulative number-average particle diameter D50p, and the particle diameters at 84% cumulation are defined as a volume particle diameter D84v and a number particle diameter D84p.

The volume particle size distribution index (GSDv) is calculated as $(D84v/D16v)^{1/2}$, and the number particle size distribution index (GSDp) is calculated as $(D84p/D16p)^{1/2}$ by using these values.

The average circularity of the toner particles is preferably 0.94 or more and 1.00 or less, and more preferably 0.95 or more and 0.98 or less.

The average circularity of the toner particles is determined by (circle-equivalent perimeter)/(perimeter) [(perimeter of the circle having the same projection area as the particle image)/(perimeter of particle projection image)]. Specifically, it is the value measured by the following method.

First, toner particles to be measured are sampled by suction so as to form a flat flow, and particle images are captured as a still image by performing instantaneous strobe light emission. The particle image is analyzed by a flow particle image analyzer (FPIA-3000 produced by Sysmex Corporation) to determine the average circularity. The number of particles sampled in determining the average circularity is 3500.

When the toner contains an external additive, the toner (developer) to be measured is dispersed in surfactant-containing water, and then ultrasonically processed to obtain toner particles from which the external additive has been removed.

External Additive

Silica particles are used as the external additive.

The volume-average particle diameter of the silica particles is preferably 40 nm or more and 400 nm or less, more preferably 50 nm or more and 300 nm or less, yet more preferably 55 nm or more and 250 nm or less, and still more preferably 60 nm or more and 200 nm or less.

When the average particle diameter of the silica particles is within the aforementioned range, the adhesion force to the toner particles is easily controlled, and the silica particles easily exhibit a spacer function between the toner particles. Thus, contamination of a recording medium caused by clogging of the transfer residual toner recovery route is easily suppressed.

The volume-average particle diameter of the silica particles is measured by the following method.

Primary particles of the silica particles are observed with a scanning electron microscope (SEM) (S-4100 produced by Hitachi, Ltd.) and imaged, and the obtained image is captured in an image analyzer (LUZEX III produced by NIRECO) to calculate the area of each particle by image analysis of the primary particles and calculate the equivalent circle diameters from the area values. The equivalent circle diameters of one hundred silica particles are calculated. Then, the 50% diameter (D50v) in the volume-based cumulative frequency of the obtained equivalent circle diameters is assumed to be the volume-average particle diameter of the silica particles.

The magnification of the electron microscope is adjusted so that ten to fifty silica particles are included in one area of view, and multiple areas of view are combined to determine the equivalent circle diameter of the primary particles.

The average circularity of the silica particles is preferably 0.75 or more and 1.0 or less, more preferably 0.9 or more and 1.0 or less, and yet more preferably 0.92 or more and 0.98 or less.

When the average circularity is within the aforementioned range, the silica particles become more spherical, the adhesion force to the toner particles is easily controlled, and the silica particles easily exhibit a spacer function between the toner particles. Thus, contamination of a recording medium caused by clogging of the transfer residual toner recovery route is easily suppressed.

The average circularity of the silica particles is measured by the following method.

First, the circularity of the silica particles is determined by observing primary particles of the silica particles with a SEM, and calculating "100/SF2" obtained by the formula below from plane image analysis of the obtained primary particles:

$$\text{circularity}(100/SF2)=4\pi\times(A/I^2) \qquad \text{Formula:}$$

where I represents the perimeter length of a primary particle on the image, and A represents a projection area of the primary particle.

The average circularity of the silica particles is obtained as a 50% circularity in the cumulative frequency of circularities of one hundred primary particles obtained by the plane image analysis described above.

The water content of the silica particles is preferably 0.5 mass % or more and 5.0 mass % or less, is more preferably 0.6 mass % or more and 4.5 mass % or less, and is yet more preferably 0.8 mass % or more and 4.0 mass % or less.

When the water content of the silica particles is within the aforementioned range, the adhesion force to the toner particles is easily controlled. Thus, contamination of a recording medium caused by clogging of the transfer residual toner recovery route is easily suppressed.

The water content of the silica particles is measured as follows.

First, the toner is added to a methanol-ethanol (1:1) mixed solution, suspended, and ultrasonically treated, and the resulting mixture is separated into the toner particles and the external additive by using a centrifugal separator to obtain a supernatant, which is a suspension containing the silica particles. The supernatant is dried to obtain a dried external additive, and the dried silica particles are stored in a 30° C., 80% constant temperature oven for 24 hours. Then, the water content of the silica particles after being stored in the constant temperature oven is measured with a heat dry-type moisture analyzer.

The surfaces of the silica particles may be hydrophobized. Hydrophobizing involves, for example, immersing inorganic particles in a hydrophobizing agent. The hydrophobizing agent may be any, and examples thereof include silane coupling agents, silicone oils, titanate coupling agents, and aluminum coupling agents. These may be used alone or in combination.

The amount of the hydrophobizing agent is typically 1 part by mass or more and 50 parts by mass or less relative to 100 parts by mass of the silica particles.

The silica particle content is preferably 0.5 mass % or more and 5.0 mass % or less, is more preferably 0.8 mass % or more and 4.6 mass % or less, and is yet more preferably 1.0 mass % or more and 4.2 mass % or less relative to the toner particles.

An external additive other than silica particles may be used in combination with the silica particles.

An example of the additional external additive is inorganic particles. Examples of the inorganic particles include $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as the additional external additive may be hydrophobized. Hydrophobizing may involve, for example, immersing inorganic particles in a hydrophobizing agent. The hydrophobizing agent may be any, and examples thereof include silane coupling agents, silicone oils, titanate coupling agents, and aluminum coupling agents. These may be used alone or in combination.

The amount of the hydrophobizing agent is typically 1 part by mass or more and 10 parts by mass or less relative to 100 parts by mass of the inorganic particles.

Examples of the additional external additive include resin particles (resin particles of polystyrene, polymethyl methacrylate (PMMA), melamine resin, etc.), and cleaning activating agents (for example, particles of metal salts of higher fatty acids such as zinc stearate and fluorine-based high-molecular-weight materials).

The externally added amount of the additional external additive is, for example, preferably 0.01 mass % or more and 5 mass % or less and is more preferably 0.01 mass % or more and 2.0 mass % or less relative to the toner particles.

Method for Producing Toner

Next, a method for producing the toner of the exemplary embodiment is described.

The toner of this exemplary embodiment is obtained by preparing toner particles and then externally adding an external additive to the toner particles.

The toner particles may be produced by a dry method (for example, a kneading and pulverizing method) or a wet method (for example, an aggregation and coalescence method, a suspension polymerization method, or a dissolution suspension method). The toner particles may be made by any known process.

Among these methods, the aggregation and coalescence method may be employed to produce toner particles.

Specifically, for example, when the toner particles are produced by the aggregation and coalescence method, toner particles are produced through a step of preparing a resin particle dispersion containing dispersed resin particles that will serve as a binder resin (resin particle dispersion preparation step); a step of inducing the resin particles (if needed, other particles) to aggregate in the resin particle dispersion (if needed, a dispersion after mixing with other particle dispersion) so as to form aggregated particles (aggregated particle forming step); and a step of heating the aggregated particle dispersion containing dispersed aggregated particles so as to fuse and coalesce the aggregated particles to form toner particles (fusing and coalescing step).

When the toner particles are produced by the aggregation and coalescence method, the method for adding the low-molecular-weight compound to the toner particles is not particularly limited. One example of the method is a method that involves adding the low-molecular-weight compound to the resin particle dispersion and inducing the resin particles (if needed, other particles) to aggregate in the resin particle dispersion containing the low-molecular-weight compound so as to form aggregated particles.

These steps will now be described in detail.

In the description below, a method for obtaining toner particles that contain a coloring agent and a releasing agent is described; however, the coloring agent and the releasing agent are optional. Naturally, additives other than the coloring agent and the releasing agent may be used. Resin particle dispersion preparation step First, a resin particle dispersion containing dispersed resin particles that will function as a binder resin and, for example, a coloring agent particle dispersion containing dispersed coloring agent particles and a releasing agent particle dispersion containing dispersed releasing agent particles are prepared.

The resin particle dispersion is, for example, prepared by dispersing resin particles in a dispersion medium by using a surfactant.

Examples of the dispersion medium used in the resin particle dispersion include aqueous media.

Examples of the aqueous media include water such as distilled water and ion exchange water, and alcohols. These may be used alone or in combination.

Examples of the surfactant include anionic surfactants such as sulfate esters, sulfonates, phosphate esters, and soaps; cationic surfactants such as amine salts and quaternary ammonium salts; and nonionic surfactants such as polyethylene glycol, alkyl phenol-ethylene oxide adducts, and polyhydric alcohols. Among these, an anionic surfactant or a cationic surfactant may be used. A nonionic surfactant may be used in combination with an anionic surfactant or a cationic surfactant.

The surfactants may be used alone or in combination.

Examples of the method for dispersing the resin particles in a dispersion medium to obtain a resin particle dispersion include typical dispersion methods that use, for example, a rotational shear-type homogenizer and a ball mill, a sand mill, and a dyno mill that use media. Depending on the type of the resin particles, for example, resin particles may be dispersed in the resin particle dispersion by a phase-inversion emulsification method.

The phase-inversion emulsification method is a method that involves dissolving a resin to be dispersed in a hydrophobic organic solvent that can dissolve that resin, adding a base to the organic continuous phase (O phase) to neutralize, and injecting a water medium (W phase) so as to perform resin conversion (phase inversion) from W/O to O/W so as to form a discontinuous phase and disperse particles of the resin in the water medium.

The volume-average particle diameter of the resin particles dispersed in the resin particle dispersion is, for example, preferably 0.01 μm or more and 1 μm or less, more preferably 0.08 μm or more and 0.8 μm or less, and yet more preferably 0.1 μm or more and 0.6 μm or less.

The volume-average particle diameter of the resin particles is measured by obtaining a particle size distribution by measurement with a laser diffraction scattering particle size distribution meter (for example, LA-700 produced by Horiba Ltd.), drawing a cumulative distribution for volume from the small particle diameter side with respect to the divided particle size ranges (channels), and determining the particle diameter at 50% accumulation with respect to all particles as the volume-average particle diameter D50v. The volume-average particle diameter of other particles in the dispersion is also measured in the same manner.

The resin particle content in the resin particle dispersion is, for example, preferably 5 mass % or more and 50 mass % or less and is more preferably 10 mass % or more and 40 mass % or less.

The coloring agent particle dispersion and the releasing agent particle dispersion are also prepared in the same manner as the resin particle dispersion, for example. The matters relating to the volume-average particle diameter, the dispersion medium, the dispersing method, and the particle content of the resin particle dispersion equally apply to the coloring agent particles dispersed in the coloring agent particle dispersion and the releasing agent particles dispersed in the releasing agent particle dispersion.

Aggregated Particle Forming Step

Next, the resin particle dispersion is mixed with the coloring agent particle dispersion and the releasing agent particle dispersion.

In the mixed dispersion, hetero-aggregation of the resin particles, coloring agent particles, and the releasing agent particles is induced so as to form aggregated particles containing the resin particles, the coloring agent particles, and the releasing agent particles and having a diameter close to the diameter of the toner particles.

Specifically, for example, an aggregating agent is added to the mixed dispersion while the pH of the mixed dispersion is adjusted to acidic (for example, a pH of 2 or more and 5 or less), and after a dispersion stabilizer is added as needed, the dispersion is heated to a temperature equal to or lower than the glass transition temperature of the resin particles (specifically, for example, a temperature 10° C. to 30° C. lower than the glass transition temperature of the resin particles) so as to aggregate the particles dispersed in the mixed dispersion and form aggregated particles.

In the aggregated particle forming step, for example, while the mixed dispersion is being stirred in a rotational shear-type homogenizer, the aggregating agent may be added to the mixed dispersion at room temperature (for example, 25° C.) and the pH of the mixed dispersion may be adjusted to acidic (for example, a pH of 2 or more and 5 or less), and then heating may be performed after the dispersion stabilizer is added as needed.

Examples of the aggregating agent include a surfactant having an opposite polarity to the surfactant used as the dispersant added to the mixed dispersion, an inorganic metal salt, and a divalent or higher valent metal complex. In particular, when a metal complex is used as the aggregating agent, the amount of the surfactant used is reduced, and the charge properties are improved.

An additive that forms a complex with a metal ion in the aggregating agent or that forms a similar bond therewith may be used as needed. An example of such an additive is a chelating agent.

Examples of the inorganic metal salt include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid, iminodiacid (IDA), nitrilotriacetic acid (NTA), and ethylenediaminetetraacetic acid (EDTA).

The amount of the chelating agent added is, for example, preferably 0.01 parts by mass or more and 5.0 parts by mass or less and more preferably 0.1 parts by mass or more and less than 3.0 parts by mass or less relative to 100 parts by mass of the resin particles.

Fusing and Coalescing Step

Next, the aggregated particle dispersion containing dispersed aggregated particles is heated to a temperature equal to or higher than the glass transition temperature of the resin particles (for example, a temperature 10° C. to 30° C. higher than the glass transition temperature of the resin particles) to fuse and unite the aggregated particles and form toner particles.

The toner particles are obtained through the above-described steps.

Note that, the toner particles may be produced by performing, after obtaining the aggregated particle dispersion containing dispersed aggregated, a step of forming second aggregated particles, the step involving mixing a resin particle dispersion containing dispersed resin particles with the aggregated particle dispersion so as to induce aggregation to attach the resin particles to the surfaces of the aggregated particles; and a step of heating a second aggregated particle dispersion containing dispersed second aggregated particles so as to fuse and unite the second aggregated particles to form toner particles having a core/shell structure.

Here, after completion of the fusing and coalescing step, the toner particles formed in the solution are subjected to a known washing step, solid-liquid separation step, and a drying step so as to obtain toner particles in a dry state.

The washing step may involve thorough displacement washing with ion exchange water from the viewpoint of chargeability. The solid-liquid separation step is not particularly limited; however, from the viewpoint of productivity, suction filtration, pressure filtration or the like may be performed. The drying step is also not particularly limited; however, from the viewpoint of productivity, freeze-drying, flash-drying, fluid-drying, vibration-type fluid-drying, or the like may be performed.

The toner of this exemplary embodiment is produced by, for example, adding an external additive to the obtained toner particles in a dry state, and mixing the resulting mixture. Mixing may be performed by using a V blender, a Henschel mixer, a Loedige mixer, or the like. If needed, a vibrating screen, an air screen, or the like may be used to remove coarse particles of the toner.

Electrostatic Charge Image Developer

The electrostatic charge image developer of the exemplary embodiment contains at least the toner of the exemplary embodiment.

The electrostatic charge image developer of the exemplary embodiment may be a one-component developer that contains only the toner of the exemplary embodiment or a two-component developer that is a mixture of the toner and a carrier.

The carrier is not particularly limited and may be any known carrier. Examples of the carrier include a coated carrier prepared by covering the surface of a magnetic powder core with a coating resin, a magnetic powder-dispersed carrier prepared by dispersing and blending magnetic powder in a matrix resin, and a resin-impregnated carrier prepared by impregnating porous magnetic powder with a resin.

The magnetic powder-dispersed carrier and the resin-impregnated carrier may each be a carrier prepared by covering a core formed of the particle that constitutes that carrier with a coating resin.

Examples of the magnetic powder include magnetic metals such as iron, nickel, and cobalt, and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylate copolymer, a straight silicone resin containing an organosiloxane bond and modified products thereof, fluororesin, polyester, polycarbonate, phenolic resin, and epoxy resin.

The coating resin and the matrix resin may contain other additives, such as conductive particles.

Examples of the conductive particles include particles of metals such as gold, silver, and copper, and particles of carbon black, titanium oxide, zinc oxide, tin oxide, barium sulfate, aluminum borate, and potassium titanate.

In order to cover the surface of the core with the coating resin, for example, a method may be used, which involves using a coating-layer-forming solution prepared by dissolving the coating resin and, if needed, various additives in an appropriate solvent. The solvent is not particularly limited and may be selected by considering the coating resin used, the suitability of application, etc.

Specific examples of the resin coating method include a dipping method involving dipping cores in the coating-layer-forming solution, a spraying method involving spraying the coating-layer-forming solution onto core surfaces, a fluid bed method involving spraying a coating-layer-forming solution while having the cores float on a bed of air, and a kneader coater method involving mixing cores serving as carriers and a coating-layer-forming solution in a kneader coater and removing the solvent.

In a two-component developer, the toner-to-carrier mixing ratio (mass ratio) is preferably 1:100 to 30:100 and is more preferably 3:100 to 20:100.

Image Forming Apparatus and Image Forming Method

The image forming apparatus and the image forming method of this exemplary embodiment will now be described.

An image forming apparatus according to the exemplary embodiment includes an image carrier; a charging unit that charges a surface of the image carrier; an electrostatic charge image-forming unit that forms an electrostatic charge image on the charged surface of the image carrier; a developing unit that contains an electrostatic charge image developer and develops the electrostatic charge image on the surface of the image carrier by using the electrostatic charge image developer so as to form a toner image; a transfer unit that transfers the toner image on the surface of the image carrier onto a surface of a recording medium; and a fixing unit that fixes the toner image on the surface of the recording medium. The electrostatic charge image developer of the exemplary embodiment is used as the aforementioned electrostatic charge image developer.

An image forming method (the image forming method of the exemplary embodiment) is performed by using the image forming apparatus of the exemplary embodiment, the method including a charging step of charging a surface of an image carrier; an electrostatic charge image forming step of forming an electrostatic charge image on the charged surface of the image carrier; a developing step of developing the electrostatic charge image on the surface of the image carrier by using the electrostatic charge image developer of the exemplary embodiment so as to form a toner image; a transferring step of transferring the toner image on the surface of the image carrier onto a surface of a recording medium; and a fixing step of fixing the toner image on the surface of the recording medium.

The image forming apparatus of the exemplary embodiment is applied to a known image forming apparatus, examples of which include a direct transfer type apparatus with which the toner image formed on the surface of the image carrier is directly transferred to the recording medium; an intermediate transfer type apparatus with which the toner image formed on the surface of the image carrier is first transferred to a surface of an intermediate transfer body and then the toner image on the surface of the intermediate transfer body is transferred to the surface of the recording medium; an apparatus equipped with a cleaning unit that cleans the surface of the image carrier after the toner image transfer and before charging; and an apparatus equipped with a charge erasing unit that erases the charges on the surface of the image carrier by applying charge erasing light after the toner image transfer and before charging.

In the intermediate transfer type apparatus, the transfer unit includes, for example, an intermediate transfer body having a surface onto which a toner image is to be transferred, a first transfer unit that conducts first transfer of the toner image on the surface of the image carrier onto the surface of the intermediate transfer body, and a second transfer unit that conducts second transfer of the toner image on the surface of the intermediate transfer body onto a surface of a recording medium.

In the image forming apparatus of the exemplary embodiment, for example, a section that includes the developing unit may be configured as a cartridge structure (process cartridge) detachably attachable to the image forming apparatus. A process cartridge equipped with a developing unit containing the electrostatic charge image developer of the exemplary embodiment may be used as this process cartridge.

Although some examples of the image forming apparatus of an exemplary embodiment are described below, these examples are not limiting. Only relevant sections illustrated in the drawings are described, and descriptions of other sections are omitted.

FIG. 1 is a schematic diagram of an image forming apparatus according to an exemplary embodiment.

An image forming apparatus illustrated in FIG. 1 is equipped with first to fourth electrophotographic image forming units 10Y, 10M, 10C, and 10K (image forming units) that respectively output yellow (Y), magenta (M), cyan (C), and black (K) images on the basis of color-separated image data. These image forming units (hereinafter may be simply referred to as "units") 10Y, 10M, 10C, and 10K are arranged side-by-side with predetermined distances between one another in the horizontal direction. These units 10Y, 10M, 10C, and 10K may each be a process cartridge detachably attachable to the image forming apparatus.

An intermediate transfer belt 20 serving as an intermediate transfer body for all of the units extends above the units 10Y, 10M, 10C, and 10K in the drawing. The intermediate transfer belt 20 is wound around a driving roll 22 and a supporting roll 24, which are spaced from each other in the horizontal direction in the drawing, and runs in a direction from the first unit 10Y to the fourth unit 10K. The supporting roll 24 is in contact with the inner surface of the intermediate transfer belt 20. A force is applied to supporting roll 24 in a direction away from the driving roll 22 by a spring or the like (not illustrated) so that a tension is applied to the intermediate transfer belt 20 wound around these two rolls. An intermediate transfer body cleaning device 30 is installed on the image carrier-side surface of the intermediate transfer belt 20 so as to face the driving roll 22.

Toners including toners of four colors, namely, yellow, magenta, cyan, and black, contained in toner cartridges 8Y, 8M, 8C, and 8K are respectively supplied to developing devices (developing units) 4Y, 4M, 4C, and 4K of the units 10Y, 10M, 10C, and 10K.

Since the first to fourth units 10Y, 10M, 10C, and 10K are identical in structure, the first unit 10Y that forms a yellow image and is disposed on the upstream side in the intermediate transfer belt running direction is described as a representative example. The descriptions of the second to fourth units 10M, 10C, and 10K are omitted by giving reference numerals having magenta (M), cyan (C), and black (K) added to the numerals.

The first unit 10Y has a photoreceptor 1Y that serves as an image carrier. A charging roll (one example of the charging unit) 2Y that charges the surface of the photoreceptor 1Y to a predetermined potential, an exposing device (one example of the electrostatic charge image forming unit) 3 that forms an electrostatic charge image by exposing the charged surface with a laser beam 3Y on the basis of a color-separated image signal, a developing device (one example of the developing unit) 4Y that develops the electrostatic charge image by supplying a charged toner to the electrostatic charge image, a first transfer roll 5Y (one example of the first transfer unit) that transfers the developed toner image onto the intermediate transfer belt 20, and a photoreceptor cleaning device (one example of the cleaning unit) 6Y that removes the toner remaining on the surface of the photoreceptor 1Y after the first transfer are provided around the photoreceptor 1Y.

The first transfer roll 5Y is disposed on the inner side of the intermediate transfer belt 20 and is positioned to face the photoreceptor 1Y. The first transfer rolls 5Y, 5M, 5C, and 5K are respectively connected to bias power supplies (not illustrated) that apply first transfer bias. The transfer bias applied to each first transfer roll from the corresponding bias power supply is controlled by a controller not illustrated in the drawing, and is variable.

Operation of forming a yellow image by using the first unit 10Y will now be described.

Prior to the operation, the surface of the photoreceptor 1Y is charged to a potential of −600 V to −800 V by using the charging roll 2Y.

The photoreceptor 1Y is formed by stacking a photosensitive layer on an electrically conductive (for example, volume resistivity at 20° C.: $1\times10^{-6}$ Ωcm or less) substrate. The photosensitive layer usually has a high resistivity (a resistivity of common resin) but when irradiated with the laser beam 3Y, the resistivity of the portion irradiated with the laser beam changes. The laser beam 3Y is output to the charged surface of the photoreceptor 1Y through the exposing device 3 in accordance with the yellow image data transmitted from the controller (not illustrated). The laser beam 3Y irradiates the photosensitive layer on the surface of the photoreceptor 1Y and an electrostatic charge image of a yellow image pattern is thereby formed on the surface of the photoreceptor 1Y.

An electrostatic charge image is an image formed on the surface of the photoreceptor 1Y by charging. A portion of the photosensitive layer irradiated with the laser bean 3Y undergoes a decrease in resistivity, and, thus, charges on the surface of the photoreceptor 1Y in that portion flow out while charges remain in the rest of the photosensitive layer not irradiated with the laser beam 3Y. Thus, the electrostatic charge image is a negative latent image.

The electrostatic charge image formed on the photoreceptor 1Y is rotated to a predetermined developing position as the photoreceptor 1Y is run. The electrostatic charge image on the photoreceptor 1Y is visualized (developed) with the developing device 4Y at this developing position so as to form a toner image.

An electrostatic charge image developer containing at least a yellow toner and a carrier is contained in the developing device 4Y, for example. The yellow toner is frictionally charged as it is stirred in the developing device 4Y and carried on the developer roll (one example of the developer-carrying member) by having charges having the same polarity (negative) as the charges on the photoreceptor 1Y. As the surface of the photoreceptor 1Y passes by the developing device 4Y, the yellow toner electrostatically adheres to the latent image portion on the photoreceptor 1Y from which charges are erased, and the latent image is thereby developed with the yellow toner. The photoreceptor 1Y on which the yellow toner image has been formed is continuously run at a predetermined speed, and the toner image developed on the photoreceptor 1Y is conveyed to a predetermined first transfer position.

After the yellow toner image on the photoreceptor 1Y is conveyed to the first transfer position, a first transfer bias is applied to the first transfer roll 5Y. Electrostatic force working from the photoreceptor 1Y toward the first transfer roll 5Y also works on the toner image, and the toner image on the photoreceptor 1Y is transferred onto the intermediate transfer belt 20. The transfer bias applied at this time has a polarity opposite to that (negative) of the toner, i.e., the polarity of the transfer bias is positive. For example, the transfer bias for the first unit 10Y is controlled to about +10 μA by the controller (not illustrated).

The toner remaining on the photoreceptor 1Y is removed by the photoreceptor cleaning device 6Y and recovered.

The first transfer bias applied to the first transfer rolls 5M, 5C, and 5K of the second unit 10M and onwards are also controlled as with the first unit.

The intermediate transfer belt 20 onto which the yellow toner image has been transferred by using the first unit 10Y travels through the second to fourth units 10M, 10C, and 10K, and toner images of respective colors are superimposed on the yellow toner image to achieve multiple transfer.

The intermediate transfer belt 20 onto which the toner images of four colors are transferred using the first to fourth units then reaches a second transfer section constituted by the intermediate transfer belt 20, the supporting roll 24 in contact with the intermediate transfer belt inner surface, and the second transfer roll (one example of the second transfer unit) 26 disposed on the image-carrying surface side of the intermediate transfer belt 20. Meanwhile, a recording sheet P (one example of the recording medium) is fed at a predetermined timing through a feeding mechanism to a space where the second transfer roll 26 and the intermediate transfer belt 20 contact each other, and a second transfer bias is applied to the supporting roll 24. The transfer bias applied at this time has the same polarity as the toner (negative). The electrostatic force from the intermediate transfer belt 20 toward the recording sheet P works on the toner image, and the toner image on the intermediate transfer belt 20 is transferred onto the recording sheet P. The second transfer bias is determined by the resistance of the second transfer section detected with a resistance detector (not illustrated) and is controlled by voltage.

Subsequently, the recording sheet P is sent to the contact portion (nip) between a pair of fixing rolls in the fixing device (one example of the fixing unit) 28, and the toner image is fixed onto the recording sheet P to form a fixed image.

Examples of the recording sheet P onto which the toner image is transferred include regular paper used in electrophotographic system copiers and printers. An example of the recording medium other than the recording sheet P is an OHP sheet.

In order to further improve the smoothness of the surface of the image after fixing, the surface of the recording sheet P may be smooth. For example, coated paper which is regular paper having a surface coated with a resin or the like and art paper for printing may be used.

The recording sheet P after fixing of the color image is conveyed toward the discharge unit, and this completes a series of color image forming operations.

Process Cartridge and Toner Cartridge

A process cartridge according to an exemplary embodiment is described.

The process cartridge of the exemplary embodiment is detachably attachable to an image forming apparatus, and includes a developing unit that contains the electrostatic charge image developer of the exemplary embodiment and develops an electrostatic charge image on the surface of the image carrier by using the electrostatic charge image developer so as to form a toner image.

The process cartridge of the exemplary embodiment is not limited to the one having the above-described structure, and may have a structure equipped with a developing device and, if needed, at least one selected from an image carrier, a charging unit, an electrostatic charge image forming unit, and a transfer unit.

One example of the process cartridge of the exemplary embodiment is described below, but this example is not limiting. Only relevant sections illustrated in the drawings are described, and descriptions of other sections are omitted.

Figure 2:
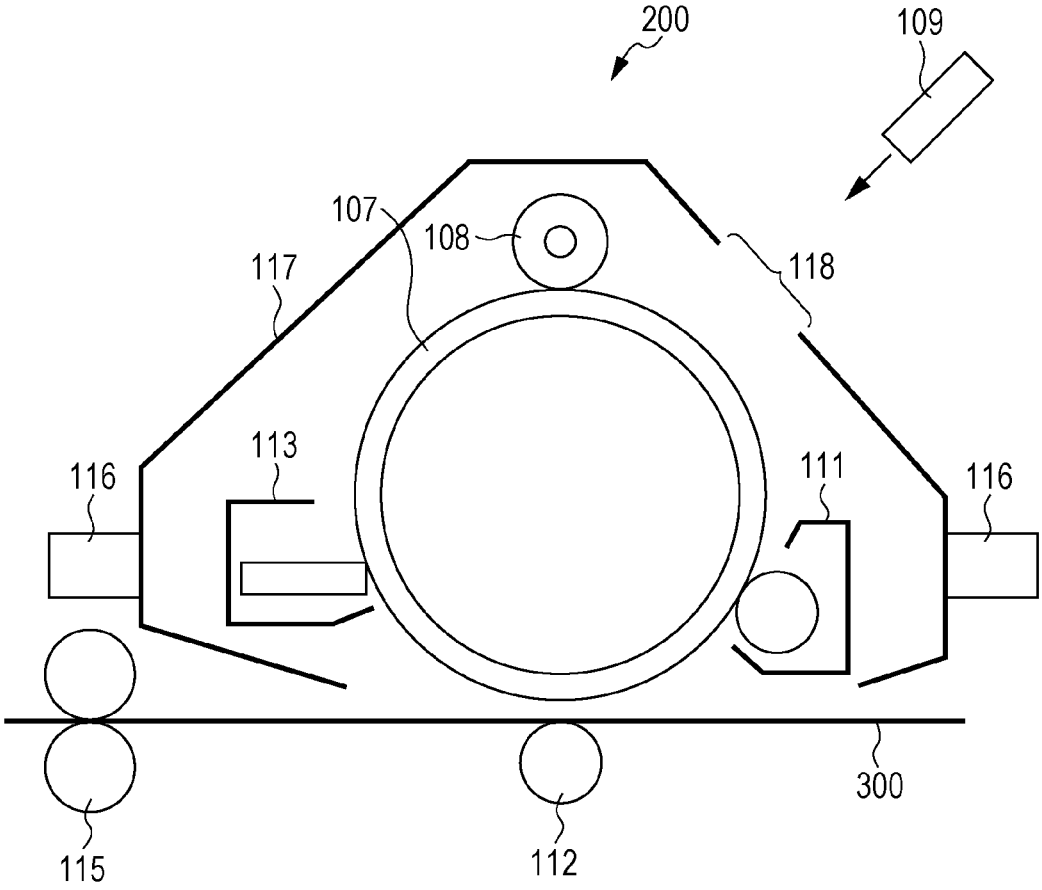
FIG. 2 is a schematic diagram of a process cartridge according to an exemplary embodiment.

FIG. 2 is a schematic diagram of a process cartridge according to the exemplary embodiment.

A process cartridge 200 illustrated in FIG. 2 includes, for example, a photoreceptor 107 (one example of the image carrier), and a charging roll 108 (one example of the charging unit), a developing device 111 (one example of the developing unit), and a photoreceptor cleaning device 113 (one example of the cleaning unit) that are disposed around the photoreceptor 107. A housing 117 having an assembly rail 116 and an opening 118 for exposure combine and integrate the aforementioned components into a cartridge.

In FIG. 2, 109 denotes an exposing device (one example of the electrostatic charge image forming unit), 112 denotes a transfer device (one example of the transfer unit), 115 denotes a fixing device (one example of the fixing unit), and 300 denotes a recording sheet (one example of the recording medium).

Next, a toner cartridge according to an exemplary embodiment is described.

The toner cartridge of the exemplary embodiment is detachably attachable to an image forming apparatus and contains a toner according to an exemplary embodiment. The toner cartridge is for storing refill toners to be supplied to the developing unit disposed inside the image forming apparatus.

The image forming apparatus illustrated in FIG. 1 has detachable toner cartridges 8Y, 8M, 8C, and 8K, and the developing devices 4Y, 4M, 4C, and 4K are respectively connected to the toner cartridges of corresponding colors through toner supply ducts not illustrated in the drawing. When the toner contained in a toner cartridge runs low, the toner cartridge is replaced.

EXAMPLES

Examples of the present disclosure will now be described in further detail, but the present disclosure is not limited by the examples. In the description below, "parts" and "%" are all on a mass basis unless otherwise noted.

Preparation of Polyester Resin Particle Dispersion

Preparation of Polyester Resin Particle Dispersion (P1-a)

Terephthalic acid: 80 parts by mole

Isophthalic acid: 20 parts by mole

Bisphenol A-ethylene oxide adduct: 20 parts by mole

Bisphenol A-propylene oxide adduct: 80 parts by mole

The above-described materials are loaded in a flask equipped with a stirrer, a nitrogen inlet tube, a temperature sensor, and a distillation column, and the temperature is increased to 210° C. in 1 hour. Then 1 part of titanium tetraethoxide is added to 100 parts of the aforementioned materials. While distilling away generated water, the temperature is increased to 230° C. in 0.5 hour, and after a dehydration condensation reaction is continued at this temperature for 1 hour, the reaction product is cooled. As such, a polyester resin (P1) is synthesized. The weight-average molecular weight (Mw) of the obtained polyester resin (P1) is 20,000.

In a container equipped with a temperature adjusting unit and a nitrogen substitution unit, 40 parts of ethyl acetate and 25 parts of 2-butanol are loaded to prepare a mixed solvent, and 100 parts of the polyester resin (P1) is gradually added thereto to be dissolved. Thereto, a 10 mass % aqueous ammonia solution (equivalent of a triple amount in terms of molar ratio with respect to the acid value of the resin) is added, followed by stirring for 30 minutes.

Next, the interior of the container is substituted with dry nitrogen, and 400 parts of ion exchange water is added to the container dropwise at a rate of 2 part/minute while maintaining the temperature at 40° C. and stirring the mixture liquid so as to perform emulsification. After completion of the dropwise addition, the emulsion is returned to room temperature (20° C. to 25° C.) and bubbled with dry nitrogen for 48 hours under stirring so as to reduce ethyl acetate and 2-butanol to 1,000 ppm or less. Then, ion exchange water is added to adjust the solid content to 20 mass %. As a result, a polyester resin particle dispersion (P1-a) having a volume-average particle diameter of 180 nm is obtained. Preparation of polyester resin particle dispersion (P1-b) A polyester resin particle dispersion (P1-b) having a volume-average particle diameter of 180 nm is obtained as with the preparation of the polyester resin particle dispersion (P1-a) except that 1.0 part of a bisphenol A-propylene oxide adduct is added when 100 parts of the polyester resin (P1) is added.

Preparation of Polyester Resin Particle Dispersion (P1-c)

A polyester resin particle dispersion (P1-c) having a volume-average particle diameter of 180 nm is obtained as with the preparation of the polyester resin particle dispersion (P1-a) except that 0.15 parts of a bisphenol A-ethylene oxide adduct is added when 100 parts of the polyester resin (P1) is added.

Preparation of Polyester Resin Particle Dispersion (P1-d)

A polyester resin particle dispersion (P1-d) having a volume-average particle diameter of 180 nm is obtained as with the preparation of the polyester resin particle dispersion (P1-a) except that 2.0 parts of a bisphenol A-propylene oxide adduct is added when 100 parts of the polyester resin (P1) is added.

Preparation of Polyester Resin Particle Dispersion (P1-e)

A polyester resin particle dispersion (P1-e) having a volume-average particle diameter of 180 nm is obtained as with the preparation of the polyester resin particle dispersion (P1-a) except that 0.3 parts of a bisphenol A-propylene oxide adduct is added when 100 parts of the polyester resin (P1) is added.

Preparation of Polyester Resin Particle Dispersion (P1-f)

A polyester resin particle dispersion (P1-f) having a volume-average particle diameter of 180 nm is obtained as with the preparation of the polyester resin particle dispersion (P1-a) except that 1.0 part of 12-hydroxystearic acid is added when 100 parts of the polyester resin (P1) is added.

Preparation of Polyester Resin Particle Dispersion (P1-g)

A polyester resin particle dispersion (P1-g) having a volume-average particle diameter of 180 nm is obtained as with the preparation of the polyester resin particle dispersion (P1-a) except that 1.0 part of myristyl alcohol is added when 100 parts of the polyester resin (P1) is added.

Preparation of Polyester Resin Particle Dispersion (P1-h)

A polyester resin particle dispersion (P1-h) having a volume-average particle diameter of 180 nm is obtained as with the preparation of the polyester resin particle dispersion (P1-a) except that 1.0 part of 1,12-dodecanediol is added when 100 parts of the polyester resin (P1) is added.

Preparation of Polyester Resin Particle Dispersion (P1-i)

A polyester resin particle dispersion (P1-i) having a volume-average particle diameter of 180 nm is obtained as with the preparation of the polyester resin particle dispersion (P1-a) except that 4.0 parts of a bisphenol A-propylene oxide adduct is added when 100 parts of the polyester resin (P1) is added.

Preparation of Polyester Resin Particle Dispersion (P1-j)

A polyester resin particle dispersion (P1-j) having a volume-average particle diameter of 180 nm is obtained as with the preparation of the polyester resin particle dispersion (P1-a) except that 0.09 parts of a bisphenol A-ethylene oxide adduct is added when 100 parts of the polyester resin (P1) is added.

Preparation of Polyester Resin Particle Dispersion (P2-a)

Terephthalic acid: 80 parts by mole
Isophthalic acid: 15 parts by mole
Trimellitic anhydride: 5 parts by mole
Bisphenol A-ethylene oxide adduct: 20 parts by mole
Bisphenol A-propylene oxide adduct: 80 parts by mole A polyester resin particle dispersion (P2-a) is obtained as with the preparation of the polyester resin particle dispersion (P1-a) except that the above-described components are used instead. The weight-average molecular weight (Mw) of the polyester resin (P2-a) is 95,000.

Preparation of Polyester Resin Particle Dispersion (P2-b)

A polyester resin particle dispersion (P2-b) having a volume-average particle diameter of 180 nm is obtained as with the preparation of the polyester resin particle dispersion (P2-a) except that 7.0 parts of a bisphenol A-ethylene oxide adduct is added when 100 parts of the polyester resin (P2) is added.

Preparation of Polyester Resin Particle Dispersion (P3)

Terephthalic acid: 80 parts by mole
Isophthalic acid: 17 parts by mole
Trimellitic anhydride: 3 parts by mole
Bisphenol A-ethylene oxide adduct: 20 parts by mole
Bisphenol A-propylene oxide adduct: 80 parts by mole A polyester resin particle dispersion (P3) is obtained as with the preparation of the polyester resin particle dispersion (P1-a) except that the above-described components are used instead. The weight-average molecular weight (Mw) of the polyester resin (P3) is 55,000.

Preparation of Polyester Resin Particle Dispersion (P4)

Terephthalic acid: 78 parts by mole
Isophthalic acid: 15 parts by mole
Trimellitic anhydride: 7 parts by mole
Bisphenol A-ethylene oxide adduct: 20 parts by mole
Bisphenol A-propylene oxide adduct: 80 parts by mole A polyester resin particle dispersion (P4) is obtained as with the preparation of the polyester resin particle dispersion (P1-a) except that the above-described components are used instead. The weight-average molecular weight (Mw) of the polyester resin (P4) is 124,000.

Preparation of Polyester Resin Particle Dispersion (P5)

Terephthalic acid: 80 parts by mole
Isophthalic acid: 15 parts by mole
Trimellitic anhydride: 5 parts by mole
Propylene glycol: 80 parts by mole
Bisphenol A-propylene oxide adduct: 20 parts by mole A polyester resin particle dispersion (P6) is obtained as with the preparation of the polyester resin particle dispersion (P1-a) except that the above-described components are used instead. The weight-average molecular weight (Mw) of the polyester resin (P6) is 95,000.

Preparation of Coloring Agent Particle Dispersion

Preparation of Coloring Agent Particle Dispersion (1)

Carbon black Regal 330 (produced by Cabot Corporation): 100 parts
Ionic surfactant (TAYCAPOWER BN2060 produced by Tayca Corporation): 10 parts
Ion exchange water: 400 parts The above-described components are mixed and treated in a high-pressure impact disperser Ultimaizer (produced by SUGINO MACHINE LIMITED) for 10 minutes at 240 MPa to obtain a coloring agent particle dispersion (1) (solid concentration: 20 mass %).

Preparation of Releasing Agent Particle Dispersion

Preparation of Releasing Agent Particle Dispersion (1)

Paraffin wax (HNP9 produced by Nippon Seiro Co., Ltd.): 100 parts
Anionic surfactant (TAYCAPOWER BN2060 produced by Tayca Corporation): 2 parts
Ion exchange water: 400 parts The above-described materials are mixed, heated to 100° C., and dispersed in a homogenizer (ULTRA-TURRAX T50 produced by IKA Japan). The resulting dispersion is further dispersed in a Manton-Gaulin high-pressure homogenizer (produced by Gaulin Company), and a releasing agent particle dispersion (1) (solid content: 20 mass %) containing dispersed releasing agent particles having a volume-average particle diameter of 210 nm is obtained as a result.

Preparation of Silica Particles

Preparation of Silica Particles (1)

After water, methanol, and ammonia water are thoroughly mixed, tetramethoxysilane and ammonia water are added thereto dropwise under heating. Next, hexamethyldisilazane (HMDS) is added to a silica sol suspension obtained by the reaction to perform hydrophobing, and the silica sol is dried to obtain silica particles. Subsequently, the silica particles are crushed to obtain silica particles (1) having a volume-average particle diameter D50v of 160 nm. The water content of the silica particles (1) is 1.7 mass %.

Preparation of Silica Particles (2)

Silica particles (2) having a volume-average particle diameter D50v of 160 nm are obtained as in the preparation of the silica particles (1) except that the added amount of hexamethyldisilazane is adjusted. The water content of the silica particles (2) is 5.2 mass %.

Preparation of Silica Particles (3)

Silica particles (3) having a D50v of 160 nm are obtained as in the preparation of the silica particles (1) except that the added amount of hexamethyldisilazane is adjusted.

The water content of the silica particles (3) is 0.7 mass %.

Preparation of Silica Particles (4)

Silica particles (4) having a D50v of 38 nm are obtained as in the preparation of the silica particles (1) except that the dropwise addition conditions are adjusted. The water content of the silica particles (4) is 2.6 mass %.

Preparation of Silica Particles (5)

Silica particles (5) having a D50v of 420 nm are obtained as in the preparation of the silica particles (1) except that the dropwise addition conditions are adjusted. The water content of the silica particles (5) is 1.4 mass %.

Example 1

Preparation of Toner Particles (1)

Resin particle dispersion (P1-b): 300 parts (loaded resin particle dispersion)

Resin particle dispersion (P2-a): 300 parts (loaded resin particle dispersion)

Releasing agent particle dispersion (1): 50 parts

Coloring agent particle dispersion (1): 50 parts

The above-described components are placed in a cylindrical stainless steel container, and dispersed and mixed in a homogenizer (ULTRA-TURRAX T50 produced by IKA Japan) for 10 minutes at 4,000 rpm while applying shear force. Next, 1.75 parts of a 10% aqueous nitric acid solution of polyaluminum chloride serving as an aggregating agent is gradually added thereto dropwise, and the resulting mixture is dispersed and mixed for 15 minutes by setting the rotating speed of the homogenizer to 5,000 rpm. As a result, a raw material dispersion is obtained.

Subsequently, the raw material dispersion is transferred to a polymerization vessel equipped with a thermometer and a stirring device that uses a four-paddle stirring blade and heated with a heating mantle under stirring at a rotating speed of 700 rpm, and growth of aggregated particles is accelerated at 45° C. During this process, the pH of the dispersion is controlled to be within the range of 2.2 to 3.5 by using 0.3N nitric acid or a 1N aqueous sodium hydroxide solution. The dispersion is retained within the pH range described above for about 2 hours to form aggregated particles.

Next, the resin particle dispersion (P1-b): 150 parts and the resin particle dispersion (P2-a): 150 parts serving as additional resin particle dispersions are added thereto so as to cause the resin particles of the binder resin to attach to the surfaces of the aggregated particles. The temperature is further elevated to 47° C., and the aggregated particles are adjusted by monitoring the size and morphology of the particles by using an optical microscope and Multisizer II. Subsequently, 2.25 parts of a chelating agent (HIDS produced by NIPPON SHOKUBAI CO., LTD.) is added thereto, then the pH is adjusted to 7.8 by using a 5% aqueous sodium hydroxide solution. This state is maintained for 15 minutes. The pH is then raised to 8.0 to fuse the aggregated particles, and then the temperature is increased to 85° C. After confirming the fusion of the aggregated particles with an optical microscope, the temperature is decreased at a rate of 1.0° C./minute. The resulting product is screened with a 20 μm mesh, repeatedly washed with water, and dried in a vacuum drier to obtain toner particles (1). The volume-average particle diameter of the obtained toner particles (1) is 5.6 μm.

Preparation of Toner (1)

Toner particles (1): 100 parts

Silica particles (1): 2.3 parts

The above-described components are mixed in a Henschel mixer at a peripheral speed of 20 m/s for 15 minutes to obtain a toner (1).

Examples 2 to 17 and Comparative Examples 1 to 5

Toners are obtained as in Example 1 except that, in preparing the toner particles (1), the type and the number of parts of the loaded resin particle dispersions and the additional resin particle dispersions are changed and the type and the number of parts of the silica particles are changed as indicated in Table 1.

Evaluation

Various Measurements

The following properties of the toners obtained in the respective examples are measured by the aforementioned methods.

Amount of change in coefficient of variation of the Si content between before and after the process ((coefficient of variation of Si content after the process)−(coefficient of variation of Si content before the process)) (in the table, simply referred to as "amount of change in Si content variation coefficient")

Coefficient of variation of the Si content after the process (in the table, simply referred to as "Si content variation coefficient")

Low-molecular-weight compound content

Ratio of components having a molecular weight of 50,000 or more in a molecular weight distribution obtained by measuring tetrahydrofuran-soluble fraction of the toner particles by gel permeation chromatography (in the table, referred to as "ratio of components having molecular weight of 50,000 or more")

Ratio B1/B2 of the measured value B1 of a specific surface area of the toner particles and the calculated specific surface area B2 of the toner particles determined from the volume-average particle diameter Absolute value |Cp−CL| of the difference between the average number Cp of carbon atoms in the polyhydric alcohol constituting the polyester resin and the number CL of carbon atoms in the low-molecular-weight compound Sheet Contamination The toner is placed in a developing device of DocuCentre-V7080N produced by Fuji Xerox Co., Ltd., and in a toner cartridge.

Next, a toner cartridge stored in a 48° C. environment for one week and a toner cartridge stored at room temperature (25° C.) are prepared.

The toner cartridge stored in a 48° C. environment for one week is loaded onto DocuCentre-V7080N produced by Fuji Xerox Co., Ltd. Then a stripe chart having an image density of 30% is output on 30,000 sheets of A4 paper by using this apparatus. Then a blank paper is output, contamination on the sheet is observed with naked eye, and evaluation is made according to the following evaluation standard.

The toner cartridge stored at room temperature (25° C.) is loaded onto DocuCentre-V7080N produced by Fuji Xerox Co., Ltd. Then, in the same manner as above, contamination on the sheet is observed with naked eye, and evaluation is made according to the following evaluation standard.

Evaluation Standard

A: No contamination is observed with naked eye on the sheet.

B: Very slight contamination is observed with naked eye, but the contamination does not pose any problem.

C: Slight contamination is observed with naked eye, but the level of the contamination is acceptable.

D: Contamination is observed with naked eye, and the level of the contamination is unacceptable.

E: Extensive contamination is observed with naked eye.

TABLE 1

| | Loaded resin particle dispersion Type/number of parts | | Additional resin particle dispersion Type/number of parts | | Silica particles Type | Water content (mass %) | D50v (μm) | Number of parts |
|---|---|---|---|---|---|---|---|---|
| Example 1 | (P1-b)/300 | (P2-a)/300 | (P1-b)/150 | (P2-a)/150 | 1 | 1.7 | 160 | 2.3 |
| Example 2 | (P1-c)/300 | (P2-a)/300 | (P1-c)/150 | (P2-a)/150 | 1 | 1.7 | 160 | 2.3 |
| Example 3 | (P1-a)/300 | (P2-b)/300 | (P1-a)/150 | (P2-b)/150 | 1 | 1.7 | 160 | 2.3 |
| Example 4 | (P1-b)/300 | (P3-a)/300 | (P1-b)/150 | (P3)/150 | 1 | 1.7 | 160 | 2.3 |
| Example 5 | (P1-d)/300 | (P2-b)/300 | (P1-d)/150 | (P2-b)/150 | 1 | 1.7 | 160 | 2.3 |
| Example 6 | (P1-e)/300 | (P2-a)/300 | (P1-e)/150 | (P2-a)/150 | 1 | 1.7 | 160 | 2.3 |
| Example 7 | (P1-b)/300 | (P4-a)/300 | (P1-b)/150 | (P4)/150 | 1 | 1.7 | 160 | 2.3 |
| Example 8 | (P1-f)/300 | (P2-a)/300 | (P1-f)/150 | (P2-a)/150 | 1 | 1.7 | 160 | 2.3 |
| Example 9 | (P1-g)/300 | (P2-a)/300 | (P1-g)/150 | (P2-a)/150 | 1 | 1.7 | 160 | 2.3 |
| Example 10 | (P1-h)/300 | (P2-a)/300 | (P1-h)/150 | (P2-a)/150 | 1 | 1.7 | 160 | 2.3 |
| Example 11 | (P1-b)/300 | (P5)/300 | (P1-b)/150 | (P5)/150 | 1 | 1.7 | 160 | 2.3 |
| Example 12 | (P1-b)/300 | (P2-a)/300 | (P1-b)/150 | (P2-a)/150 | 2 | 0.4 | 160 | 2.3 |
| Example 13 | (P1-b)/300 | (P2-a)/300 | (P1-b)/150 | (P2-a)/150 | 3 | 5.2 | 160 | 2.3 |
| Example 14 | (P1-b)/300 | (P2-a)/300 | (P1-b)/150 | (P2-a)/150 | 1 | 1.7 | 160 | 1.6 |
| Example 15 | (P1-b)/300 | (P2-a)/300 | (P1-b)/150 | (P2-a)/150 | 1 | 1.7 | 160 | 3.4 |
| Example 16 | (P1-b)/300 | (P2-a)/300 | (P1-b)/150 | (P2-a)/150 | 4 | 2.6 | 38 | 1.8 |
| Example 17 | (P1-b)/300 | (P2-a)/300 | (P1-b)/150 | (P2-a)/150 | 5 | 1.4 | 420 | 2.6 |
| Comparative Example 1 | (P1-a)/300 | (P2-a)/300 | (P1-a)/150 | (P2)/150 | 1 | 1.7 | 160 | 2.3 |
| Comparative Example 2 | (P1-i)/300 | (P2-b)/300 | (P1-i)/150 | (P2-b)/150 | 1 | 1.7 | 160 | 2.3 |
| Comparative Example 3 | (P1-j)/300 | (P2-b)/300 | (P1-j)/150 | (P2-b)/150 | 1 | 1.7 | 160 | 2.3 |
| Comparative Example 4 | (P1-b)/400 | (P3-a)/200 | (P1-b)/400 | (P3)/200 | 1 | 1.7 | 160 | 2.3 |
| Comparative Example 5 | (P1-b)/260 | (P4-a)/340 | (P1-b)/130 | (P4)/170 | 1 | 1.7 | 160 | 2.3 |

TABLE 2

| | Amount of change in Si content variation coefficient | Si content variation coefficient (after process) | Low-molecular-weight compound Type | Low-molecular-weight compound Amount (ppm) | Ratio of components having molecular weight of 50,000 or more (mass %) | Toner particle specific surface area Observed value B1 | Toner particle specific surface area Calculated value B2 | Ratio B1/B2 | ICp-CLI | Sheet contamination High temperature After storage | Sheet contamination Room temperature After storage |
|---|---|---|---|---|---|---|---|---|---|---|---|
| Example 1 | 0.37 | 0.48 | Bisphenol A-propylene oxide adduct | 5,000 | 37 | 2.3 | 1.0 | 2.3 | 0.4 | A | A |
| Example 2 | 0.08 | 0.32 | Bisphenol A-ethylene oxide adduct | 700 | 37 | 2.3 | 1.0 | 2.3 | 1.6 | C | C |
| Example 3 | 0.56 | 0.67 | Bisphenol A-propylene oxide adduct | 35,000 | 37 | 2.3 | 1.0 | 2.3 | 0.4 | C | C |
| Example 4 | 0.17 | 0.22 | Bisphenol A-propylene oxide adduct | 5,000 | 18 | 2.3 | 1.0 | 2.3 | 0.4 | C | C |

TABLE 2-continued

| | Amount of change in Si content variation coefficient | Si content variation coefficient (after process) | Low-molecular-weight compound Type | Low-molecular-weight compound Amount (ppm) | Ratio of components having molecular weight of 50,000 or more (mass %) | Toner particle specific surface area Observed value B1 | Toner particle specific surface area Calculated value B2 | Toner particle specific surface area Ratio B1/B2 | ICp-CLI | Sheet contamination High temperature After storage | Sheet contamination Room temperature After storage |
|---|---|---|---|---|---|---|---|---|---|---|---|
| Example 5 | 0.42 | 0.77 | Bisphenol A-propylene oxide adduct | 45,000 | 29 | 2.3 | 1.0 | 2.3 | 0.4 | C | C |
| Example 6 | 0.12 | 0.23 | Bisphenol A-propylene oxide adduct | 1,500 | 37 | 2.3 | 1.0 | 2.3 | 0.4 | B | B |
| Example 7 | 0.07 | 0.42 | Bisphenol A-propylene oxide adduct | 5,000 | 48 | 2.3 | 1.0 | 2.3 | 0.4 | C | C |
| Example 8 | 0.14 | 0.25 | 12-Hydroxystearic acid | 5,000 | 37 | 2.3 | 1.0 | 2.3 | 2.6 | C | C |
| Example 9 | 0.16 | 0.26 | Myristyl alcohol | 5,000 | 37 | 2.3 | 1.0 | 2.3 | 6.6 | B | B |
| Example 10 | 0.13 | 0.26 | 1,12-Dodecane diol | 5,000 | 37 | 2.3 | 1.0 | 2.3 | 8.6 | C | C |
| Example 11 | 0.21 | 0.36 | Bisphenol A-propylene oxide adduct | 5,000 | 37 | 2.3 | 1.0 | 2.3 | 7.4 | B | B |
| Example 12 | 0.37 | 0.48 | Bisphenol A-propylene oxide adduct | 5,000 | 37 | 2.3 | 1.0 | 2.3 | 0.4 | C | C |
| Example 13 | 0.37 | 0.48 | Bisphenol A-propylene oxide adduct | 5,000 | 37 | 2.3 | 1.0 | 2.3 | 0.4 | C | C |
| Example 14 | 0.26 | 0.36 | Bisphenol A-propylene oxide adduct | 5,000 | 37 | 1.1 | 1.0 | 1.1 | 0.4 | C | C |
| Example 15 | 0.21 | 0.29 | Bisphenol A-propylene oxide adduct | 5,000 | 37 | 5.2 | 1.0 | 5.2 | 0.4 | C | C |
| Example 16 | 0.32 | 0.42 | Bisphenol A-propylene oxide adduct | 5,000 | 37 | 2.8 | 1.0 | 2.8 | 0.4 | C | B |
| Example 17 | 0.31 | 0.54 | Bisphenol A-propylene oxide adduct | 5,000 | 37 | 1.9 | 1.0 | 1.9 | 0.4 | B | C |
| Comparative Example 1 | 0.01 | 0.12 | None | 0 | 37 | 2.3 | 1.0 | 2.3 | — | E | E |
| Comparative Example 2 | 0.64 | 0.82 | Bisphenol A-propylene oxide adduct | 53,000 | 29 | 2.3 | 1.0 | 2.3 | 0.4 | D | D |
| Comparative Example 3 | 0.04 | 0.24 | Bisphenol A-propylene oxide adduct | 400 | 37 | 2.3 | 1.0 | 2.3 | 0.4 | D | D |
| Comparative Example 4 | 0.03 | 0.27 | Bisphenol A-propylene oxide adduct | 6,600 | 13 | 2.3 | 1.0 | 2.3 | 0.4 | D | D |
| Comparative Example 5 | 0.03 | 0.37 | Bisphenol A-propylene oxide adduct | 4,400 | 52 | 2.3 | 1.0 | 2.3 | 0.4 | D | D |

These results indicate that the toners of the examples have less sheet contamination after storage at high temperature and after storage at room temperature compared to the toners of the comparative examples.

Thus, it is found that the toners of the examples suppress contamination of a recording medium caused by clogging of the transfer residual toner recovery route irrespective of whether heat is applied to the toner.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A toner for developing an electrostatic charge image, the toner comprising:

toner particles containing a binder resin; and an external additive containing silica particles, wherein a coefficient of variation of a Si content is determined by determining the Si content in a plurality of 0.5 μm×0.5 μm square regions in a surface of each of the toner particles after performing a process of dispersing the toner in water and drying the dispersed toner, and an amount of change between this coefficient of variation of the Si content and a coefficient of variation of a Si content before the process ((coefficient of variation of Si content after process)−(coefficient of variation of Si content before process)) is 0.05 or more and 0.60 or less, wherein the coefficient of variation of Si content is calculated by the following formula:

coefficient of variation of Si content=(standard deviation)/(average value), and wherein the process of dispersing the toner in water and drying the dispersed toner comprises the following steps:

preparing an aqueous solution by adding 2 g of the toner to 100 mL of a 0.2 mass % aqueous solution of 2-[4-(2,4,4-trimethylpentan-2-yl)phenoxy]ethanol, stirring the aqueous solution for 10 minutes by using a magnetic stirrer at a rotating speed of 250 rpm and then processing the resulting solution in a centrifugal separator to remove silica particles that have detached from the toner particles, and removing the silica particles that have detached from the toner particles and then drying the toner at a temperature of 40° C. for 24 hours, and wherein a ratio B1/B2 is 1.2 or more and 5.0 or less, where B1 represents a measured value of a specific surface area of the toner particles and B2 represents a calculated specific surface area of the toner particles calculated from a volume-average particle diameter.

2. The toner according to claim 1, wherein the coefficient of variation of the Si content after the process is 0.20 or more and 0.80 or less.

3. The toner according to claim 2, wherein the coefficient of variation of the Si content after the process is 0.25 or more and 0.70 or less.

4. The toner according to claim 1, wherein the binder resin contains a polyester resin formed of a condensation polymer of a polycarboxylic acid and a polyhydric alcohol.

5. The toner according to claim 1, wherein the silica particles have a water content of 0.5 mass % or more and 5.0 mass % or less.

6. An electrostatic charge image developer comprising the toner for developing an electrostatic charge image according to claim 1.

7. A toner cartridge detachably attachable to an image forming apparatus, the toner cartridge comprising the toner for developing an electrostatic charge image according to claim 1.

* * * * *